United States Patent [19]

Bailey

[11] 4,142,580

[45] Mar. 6, 1979

[54] BAYONET HEAT EXCHANGER HAVING MEANS FOR POSITIONING BAYONET TUBE IN SHEATH TUBE

[75] Inventor: Clyde E. Bailey, Beatrice, Nebr.

[73] Assignee: Phillips Petroleum Company, Bartlesville, Okla.

[21] Appl. No.: 743,194

[22] Filed: Nov. 19, 1976

[51] Int. Cl.[2] ..... F28D 7/12

[52] U.S. Cl. ..... 165/142; 432/223; 122/181

[58] Field of Search ..... 165/142; 122/305–320, 122/133, 143, 173, 180, 181, 184, 186; 220/445

[56] References Cited

U.S. PATENT DOCUMENTS

| | | | |
|---|---|---|---|
| 1,511,056 | 10/1924 | Ercanbrack | 165/142 |
| 2,174,318 | 9/1939 | Ellis | 165/142 |
| 2,243,593 | 5/1941 | Zallea | 165/142 |
| 2,649,285 | 8/1953 | Brown, Jr. | 165/142 X |

FOREIGN PATENT DOCUMENTS

| | | | |
|---|---|---|---|
| 1955346 | 5/1971 | Fed. Rep. of Germany | 165/142 |
| 6608126 | 12/1966 | Netherlands | 165/142 |
| 928633 | 6/1947 | France | 165/142 |
| 66081126 | 12/1966 | Netherlands | 165/192 |

*Primary Examiner*—Charles J. Myhre
*Assistant Examiner*—Theophil W. Struele, Jr.

[57] ABSTRACT

Each sheath tube of a bayonet type heat exchanger is provided with spacer means secured thereto and extending inwardly from the inner wall surface thereof to define an opening through which the respective bayonet tube freely extends at least generally coaxially with the sheath tube, the surface of the spacer means adjacent the bayonet tube being smoothly contoured to substantially minimize damage to the bayonet tube from vibration.

10 Claims, 2 Drawing Figures

BAYONET HEAT EXCHANGER HAVING MEANS FOR POSITIONING BAYONET TUBE IN SHEATH TUBE

Figure 1:
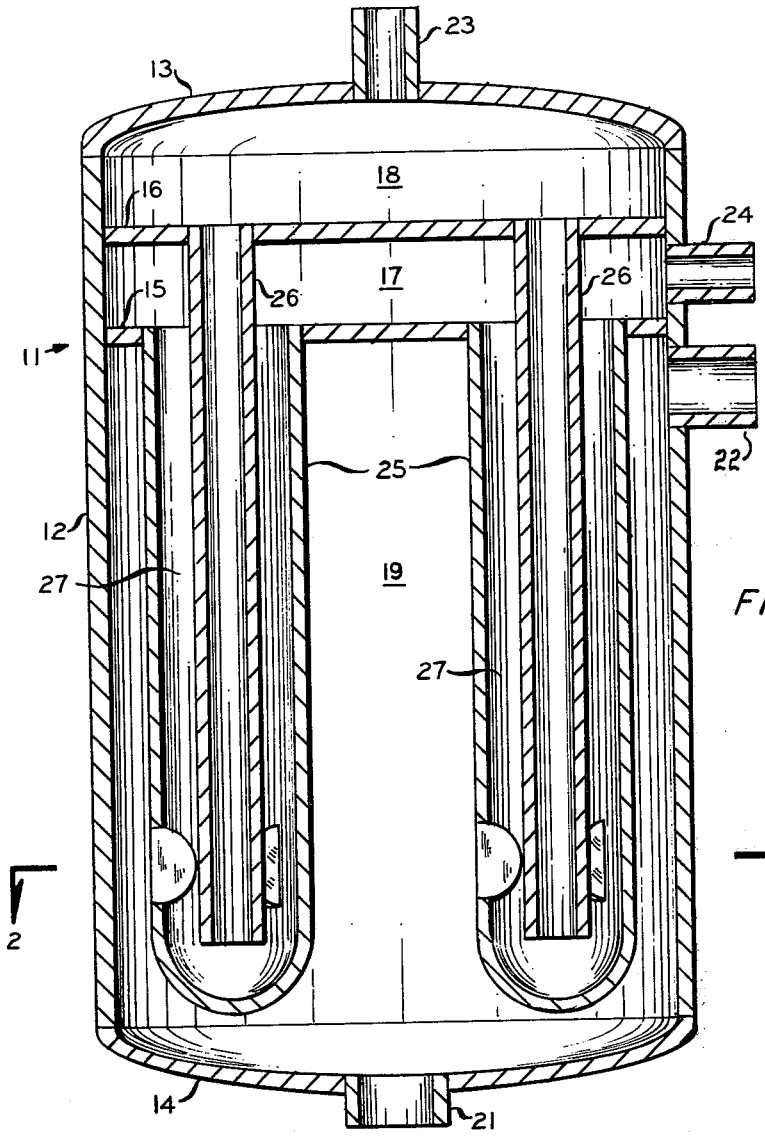

This invention relates to heat exchanger apparatus. In one aspect the invention relates to means for spacing a bayonet tube from the associated sheath tube in a bayonet heat exchanger.

In bayonet heat exchangers, it is not uncommon for the bayonet tubes and the sheath tubes to have vertical lengths in excess of 6 meters. In order to minimize hot spots which could occur when a bayonet tube is not properly centered in its sheath tube, it is generally necessary to provide spacer elements for centering the bayonet tube in the sheath tube. One type of spacer element which has been employed in this service is formed by overlapping two nails, which are bent at an acute angle, to form a four-legged W configuration with the heads at opposite ends, and welding the two nails together at the overlap point and welding the heads to the bayonet tube. However, as a result of the hydraulically induced vibrations and mechanically induced vibrations frequently encountered in such equipment, some of the nails wear holes in the sheath tubes, thereby causing a loss of the fluid being heated while diluting the hot combustion gases. While the nails could be replaced with solid bars mounted on the distal end of the bayonet tube, any vibration could still cause the formation of holes in the sheath tube.

Accordingly, it is an object of the present invention to provide a new and improved bayonet heat exchanger. Another object of the invention is to minimize the wearing of holes in the sheath tubes. Another object of the invention is to avoid the loss of the fluid being heated. A further object of the invention is to avoid the dilution of the combustion gas by fluid leaking from the sheath tubes. Other objects, aspects and advantages of the invention will be apparent from a study of the specification, the drawings and the appended claims to the invention.

In accordance with the present invention these difficulties can be overcome and the foregoing objectives achieved by mounting spacer means on the interior of the distal portion of the sheath tube such that the bayonet tube freely extends therethrough. The surface of the spacer means subject to contact with the bayonet tube is preferably smoothly contoured to substantially minimize damage to the bayonet tube resulting from vibration. In a presently preferred embodiment each spacer means comprises at least three spacer elements spaced apart at approximately equal distances about the inner periphery of the sheath tube. The spacer elements can extend through the wall of the sheath tube and be welded thereto, and can be provided with an inclined surface to aid in the assembling of the bayonet tube into the sheath tube.

Figure 2:
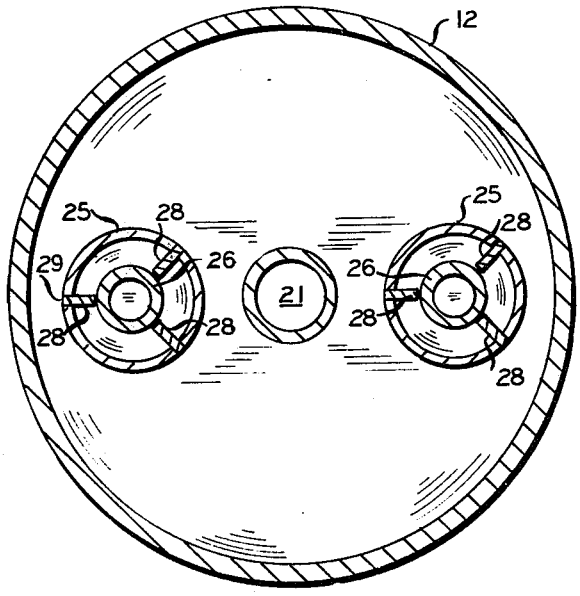

In the drawings,

FIG. 1 is a simplified view in vertical cross section of a bayonet heat exchanger embodying the present invention and FIG. 2 is a cross sectional view taken along line 2—2 in FIG. 1.

The bayonet heat exchanger 11 illustrated in the drawings comprises a cylindrical shell 12, and upper head 13, a lower head 14, a lower tube sheet 15 and an upper tube sheet 16. Shell 12 and tube sheets 15 and 16 define a first fluid manifold chamber 17, while shell 12, head 13 and tube sheet 16 define a second fluid manifold chamber 18, and shell 12, tube sheet 15 and head 14 define a heat exchange chamber 19. A combustion gas inlet conduit 21 is connected to head 14 in fluid communication with the lower portion of chamber 19. Similarly a combustion gas outlet conduit 22 is connected to shell 12 in fluid communication with the upper portion of chamber 19. A heat exchange fluid inlet conduit 23 is connected to head 13 in fluid communication with chamber 18, while a heat exchange fluid outlet conduit 24 is connected to shell 12 in fluid communication with chamber 17. A plurality of sheath tubes 25 extend downwardly from tube sheet 15 into chamber 19, each of tubes 25 being open at the upper end in fluid communication with chamber 17 and being closed at the distal end. Each of a plurality of bayonet tubes 26 extends downwardly from tube sheet 16 through the chamber 17 and the open upper end of a respective sheath tube 25 for a substantial distance along the length of the respective sheath tube 25. The external dimensions of each bayonet tube 26 are smaller than the corresponding internal dimensions of the associated sheath tube 25 to provide an annular fluid flow passageway 27 between the outer wall surface of the bayonet tube 26 and the inner wall surface of the associated sheath tube 25. The upper end of each bayonet tube 26 is open and in fluid communication with chamber 18, while the lower or distal end of each bayonet tube 26 is open and in fluid communication with the respective annular fluid flow passageway 27.

Each sheath tube 25 is provided with at least one spacer means for maintaining the lower or distal portion of the associated bayonet tube spaced from the transversely adjacent portion of the sheath tube while permitting the passage of fluid through the respective annular flow passageway 27. In the illustrated embodiment each spacer means comprises three spacer elements 28 spaced apart from each other at at least generally equal distances, i.e. 120°, about the inner periphery of the portion of the sheath tube transversely adjacent a lower or distal portion of the bayonet tube 26. The set of three spacer elements 28 extends radially inwardly toward the elongated axis of the respective bayonet tube 26 to form an opening between the inner surfaces thereof slightly larger than the external diameter of bayonet tube 26 so that the bayonet tube 26 freely extends through this opening at least generally coaxially with respective sheath tube 25. The inner surfaces of the spacer elements 28 adjacent to and subject to contact by the bayonet tube 26 are preferably smoothly contoured to at least substantially minimize damage to the bayonet tube resulting from vibration of either the bayonet tube 26 or the sheath tube 25.

Each sheath tube 25 is provided with slots 29 extending through the wall thereof corresponding in number and location to the number and location of spacer elements 28, with the shape of each slot corresponding to the shape of the base portion of the respective spacer element 28. The spacer elements 28 are positioned in the slots 29 so that the spacer elements 28 extend through the wall of the sheath tube 25 into the annular space 27. The base of the spacer elements 28 can be welded to the wall of sheath tube 25 to form a fluid tight joint between each spacer element 28 and the sheath tube 25.

Each spacer element 28 is in the form of a bar or solid plate with the long dimension thereof at least generally parallel to the elongated axis of the respective sheath tube. The height, from the inner surface of the sheath tube 25, of bar 28 varies in a convex curve along the length of the bar which parallels the length of the respective sheath tube 25. This provides each spacer element 28 with a first, or middle, section of maximum height from the inner wall surface of the respective sheath tube 25 along a line perpendicular to the inner wall surface of the sheath tube 25, i.e. radial to the elongated axis of the sheath tube, and an upper section, immediately adjacent the section of maximum height on the side thereof closest to the chamber 17, which diverges from the outer wall of the respective bayonet tube 26. This divergence facilitates the insertion of the distal end of the bayonet tube through the central opening formed by the spacer elements 28 during the assembling of the heat exchanger. The sections of maximum height of the spacers 28 preferably occur at least substantially at the same location along the length of the respective sheath tube 25.

Reasonable variations and modifications are possible within the scope of the foregoing disclosure, the drawings and the appended claims to the invention. While only two sheath tubes and two bayonet tubes have been illustrated for purposes of simplicity, any desired number can be employed. The sheath tube and the associated bayonet tube can have any desired configurations so long as the bayonet tube can be freely inserted into the sheath tube. The spacer means can be in the form of two or more spacer elements or in the form of an annular ring having flow passageways therethrough. While it is preferable for the spacer elements in a set to be positioned at the same location along the length of the sheath tube, they can be axially separated. More than one set of spacer elements can be employed on a sheath tube to provide centering support at intermediate positions as well as the distal position.

That which is claimed is:

1. In a bayonet heat exchanger having means defining a first fluid manifold chamber, means defining a second fluid manifold chamber, means defining a heat exchanger chamber, a plurality of sheath tubes extending from said first fluid manifold chamber into said heat exchanger chamber, each of said sheath tubes having an open first end connected in fluid communication with said first manifold chamber and a closed distal end, a plurality of bayonet tubes, each of said bayonet tubes extending from said second fluid manifold chamber a substantial distance into a respective sheath tube through the open first end of the respective sheath tube, the distal end of each bayonet tube being open, the external dimensions of each bayonet tube being smaller than the corresponding internal dimensions of the respective sheath tube to provide an annular fluid flow passageway between said bayonet tube and the respective sheath tube, and means for maintaining the distal portion of each bayonet tube spaced from the transversely adjacent portion of the respective sheath tube while permitting the passage of fluid through the respective annular flow passageway; the improvement wherein said means for maintaining comprises spacer means secured to said transversely adjacent portion of the respective sheath tube and providing an opening through which the respective bayonet tube freely extends at least generally coaxially with the respective sheath tube, each said spacer means comprising a plurality of spacer elements, each said sheath tube having a plurality of longitudinal slots extending through the wall thereof corresponding in number and location to the number and location of said corresponding spacer elements, with the size and shape of each of said slots corresponding to the size and shape of a respective spacer element, each said spacer element being a solid bar element with the long dimension thereof at least generally parallel to the elongated axis of the respective sheath tube, each said bar element extending inwardly through a respective slot of a respective sheath tube with said bar element fixedly secured to the wall of the respective sheath tube to form a fluid tight joint therebetween and having at least the innermost side surface of the bar element diverging from the respective bayonet tube in the direction of said first fluid manifold chamber.

2. A bayonet heat exchanger in accordance with claim 1 wherein the surface of said spacer means adjacent the respective bayonet tube is smoothly contoured to substantially minimize damage to the bayonet tube resulting from vibration of either the bayonet tube or the respective sheath tube.

3. A bayonet heat exchanger in accordance with claim 1 wherein each said spacer means comprises at least three spacer elements spaced apart about the inner periphery of said transversely adjacent portion of the respective sheath tube.

4. A bayonet heat exchanger in accordance with claim 3 wherein said spacer elements are spaced apart from each other at at least generally equal distances.

5. A bayonet heat exchanger in accordance with claim 1 wherein the height of each bar element varies in a convex curve along the length thereof in the direction of the length of the respective sheath tube.

6. A bayonet heat exchanger in accordance with claim 3 wherein the height of each bar element varies in a convex curve along the length thereof in the direction of the length of the respective sheath tube.

7. A bayonet heat exchanger in accordance with claim 1 wherein each spacer means comprises three spacer elements spaced apart at approximately 120° intervals about the inner periphery of said transversely adjacent portion of the respective sheath tube.

8. A bayonet heat exchanger in accordance with claim 1 wherein each bar element has a first section of maximum height from the inner wall surface of the respective sheath tube along a line perpendicular to the inner wall surface of the sheath tube, and wherein the section of each bar element immediately adjacent said section of maximum height on the side thereof closest to said first fluid manifold chamber diverges from the outer wall of the respective bayonet tube to facilitate the insertion of the distal end of the respective bayonet tube through the central opening formed by the bar elements.

9. A bayonet heat exchanger in accordance with claim 8 wherein the sections of maximum height of the bar elements on a respective sheath tube occur at least substantially at the same location along the length of the respective sheath tube.

10. A bayonet heat exchanger in accordance with claim 9 wherein said means defining a first fluid manifold chamber comprises first and second spaced apart tube sheets with said second tube sheet separating said first and second fluid manifold chambers, said sheath tubes being secured to said first tube sheet and said bayonet tubes being secured to said second tube sheet.

* * * * *